US007667937B2

(12) United States Patent
Mangold et al.

(10) Patent No.: US 7,667,937 B2
(45) Date of Patent: Feb. 23, 2010

(54) CONTROL DEVICE FOR AN ELECTRONIC DOMESTIC APPLIANCE

(75) Inventors: Harald Mangold, Lippach (DE); Thomas Baumann, Bad Wurzach (DE)

(73) Assignee: Diehl AKO Stiftung & Co. KG, Wangen (DE)

( * ) Notice: Subject to any disclaimer, the term of this patent is extended or adjusted under 35 U.S.C. 154(b) by 0 days.

(21) Appl. No.: 12/182,611

(22) Filed: Jul. 30, 2008

(65) Prior Publication Data

US 2009/0062962 A1 Mar. 5, 2009

(30) Foreign Application Priority Data

Aug. 31, 2007 (DE) ..... 10 2007 041 534

(51) Int. Cl.
*H02H 9/00* (2006.01)
*H02H 1/00* (2006.01)

(52) U.S. Cl. ..... 361/58

(58) Field of Classification Search ..... 361/58
See application file for complete search history.

(56) References Cited

U.S. PATENT DOCUMENTS

| | | | | |
|---|---|---|---|---|
| 4,237,421 | A | 12/1980 | Waldron | |
| 4,547,842 | A * | 10/1985 | Beierholm et al. | 363/35 |
| 4,731,548 | A | 3/1988 | Ingraham | |
| 6,315,523 | B1 * | 11/2001 | Mills | 417/45 |
| 6,628,485 | B1 * | 9/2003 | Rajala et al. | 361/31 |
| 2007/0041145 | A1 * | 2/2007 | Losehand | 361/272 |
| 2008/0174259 | A1 * | 7/2008 | Miettinen | 318/601 |

FOREIGN PATENT DOCUMENTS

| | | | |
|---|---|---|---|
| DE | 2942097 | A1 | 5/1980 |
| DE | 29520531 | U1 * | 4/1997 |
| DE | 19712137 | A1 | 9/1998 |
| DE | 19806043 | A1 | 8/1999 |
| EP | 0262909 | A2 | 4/1988 |
| EP | 0858166 | A1 | 8/1998 |
| WO | 2007025851 | A1 | 3/2007 |

* cited by examiner

*Primary Examiner*—Ronald W Leja
(74) *Attorney, Agent, or Firm*—Laurence A. Greenberg; Werner H. Stemer; Ralph E. Locher

(57) ABSTRACT

A control device for an electronic domestic appliance has a control panel of an electrically conducting material and an electronic control system with a mains-connected circuit and a circuit that is galvanically separated from the mains. To protect the electronic control system from electrostatic discharges the control panel is grounded by way of an electrical connection between the control panel and the circuit that is galvanically separated from the mains and also an electrical connection between the galvanically separated circuit and the mains-connected circuit. The latter electrical connection between the galvanically separated circuit and the mains-connected circuit has at least one protection impedance.

5 Claims, 1 Drawing Sheet

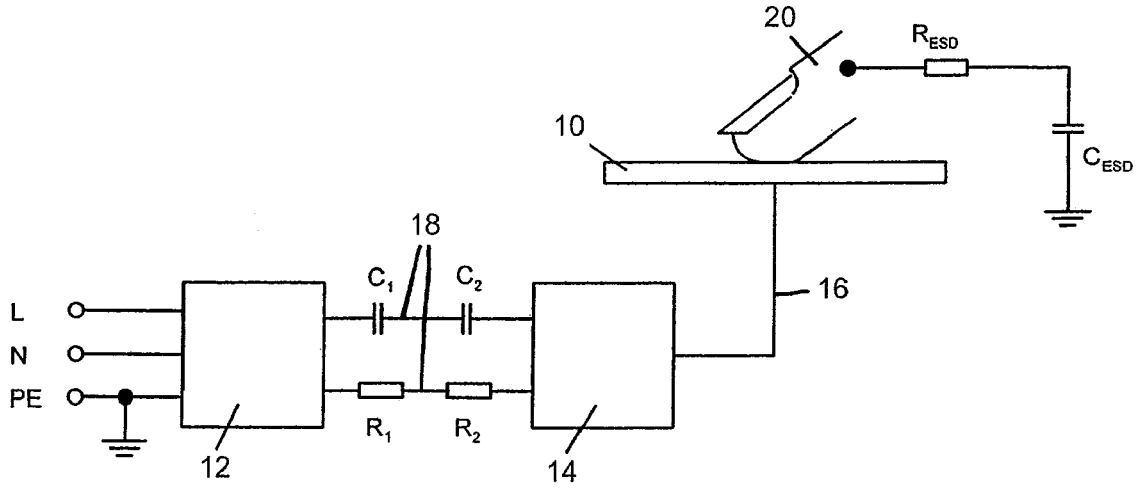
20
$R_{ESD}$
10
$C_{ESD}$
18
$C_1$
$C_2$
16
L
N
PE
$R_1$
$R_2$
12
14

CONTROL DEVICE FOR AN ELECTRONIC DOMESTIC APPLIANCE

CROSS-REFERENCE TO RELATED APPLICATION

This application claims the priority, under 35 U.S.C. §119, of German application DE 10 2007 041 534.8, filed Aug. 31, 2007; the prior application is herewith incorporated by reference in its entirety.

BACKGROUND OF THE INVENTION

Field of the Invention

The present invention concerns a control device for an electronic domestic appliance including a control panel of an electrically conducting material and an electronic control system having a mains-connected circuit and a circuit that is galvanically separated from the mains.

Electronic domestic appliances such as cookers, ceramic cook tops, washing machines, dryers, dishwashers and the like usually have a control panel and an electronic control system. The control panel includes a number of control and display elements.

In the use of control panels comprising an electrically conducting material such as for example high-quality steel, malfunctions of the electronic control system can be caused in the state of the art as a consequence of electrostatic discharges (ESD) produced by electrostatically charged persons who touch the control panel. Touching the control panel, due to air or contact discharge, gives rise to charge equalization between the person who can be charged up with a relatively high voltage, and the control panel. It has been found that, because of the volume of the conducting material, those discharges occur even when the electrically conducting control panel is not connected to ground or is only connected to ground through a very high resistance.

Current pulses are produced upon electrostatic discharge which usually have to be carried away to ground as the person has a voltage in relation to ground. Voltage drops occur on the possibly excessively highly resistive current path due to those current pulses, and the high gradients cause electromagnetic fields. Furthermore charge shifts and thus interference voltages in the highly resistive circuit portions can occur due to the applied charge, in particular if the charge is not conducted away sufficiently quickly. Those phenomena frequently result in malfunctions of the electronic control system because the current path goes directly by way of the electronic system or the electronic system is disposed in the area of influence of the electromagnetic or electrostatic fields which occur due to the discharge.

In the case of an electronic control system which is electrically connected to a control panel of an electrically conducting material or which is not adequately insulated therefrom for functional or structural reasons, the circuit portion which makes the connection to the control panel or which does not ensure the adequate insulation must be a circuit in protection class II, that is to say a low-voltage circuit which can be touched. Such a circuit in protection class II is distinguished in that it involves galvanic separation in relation to a mains-connected circuit which does not allow any flow of current to ground. In the state of the art the control panel is grounded directly in order to provide that such an arrangement is insensitive to electrostatic discharges.

In many cases however direct grounding of the control panel is not possible for structural or other reasons. There is therefore a need for a solution for also reliably avoiding in such cases a malfunction of the electronic control system by virtue of electrostatic discharges.

SUMMARY OF THE INVENTION

It is accordingly an object of the invention to provide a operator's control panel for an electronic domestic appliance which overcomes the above-mentioned disadvantages of the heretofore-known devices and methods of this general type and which has a control panel of an electrically conducting material, which ensures adequate protection for the electronic control system in relation to electrostatic discharges, even if direct grounding of the control panel is not possible.

With the foregoing and other objects in view there is provided, in accordance with the invention, a control device for an electronic domestic appliance, comprising:

a control panel of electrically conducting material;

an electronic control system having a first circuit connected to mains and a second circuit galvanically separated from the mains;

an electrical connection connecting said control panel and said second circuit, for grounding said control panel;

an electrical connection between said second circuit and said mains-connected first circuit, said electrical connection between said second circuit and said first circuit including at least one protection impedance.

In other words, the control device for an electronic domestic appliance includes a control panel of an electrically conducting material and an electronic control system having a mains-connected circuit and a circuit galvanically separated from the mains. To attain the above-indicated object, the control device has a control panel that is grounded by way of an electrical connection between the control panel and the first circuit (i.e., the circuit that is galvanically separated from the mains) and an electrical connection between the first circuit and the second circuit (i.e., the mains-connected circuit). The electrical connection between the circuit that is galvanically separated from the mains and the mains-connected circuit has at least one protection impedance.

The electrical connection between the control panel and the circuit galvanically separated from the mains and the electrical connection between the circuit galvanically separated from the mains and the mains-connected circuit (which usually has a ground connection) provides that the charge which is applied to the control panel by the electrostatic discharge can be quickly discharged to ground by way of the two circuits of the electronic control system. For safety reasons however the electrical connection between the circuit galvanically separated from the mains and the mains-connected circuit must be provided with protection impedances in order to limit an effective current which could flow away to ground from the mains by way of the person touching the control panel, to a level which is harmless to the person.

In accordance with an added feature of the invention, the at least one protection impedance has at least two series-connected protection impedances.

Both capacitive protection impedances for the discharge of high current gradients (HF-discharge) and also ohmic protection impedances for the discharge of the static charge (DC-discharge) can be used as protection impedances.

In a preferred embodiment of the invention the at least one protection impedance has a parallel connection of capacitive protection impedances and ohmic protection impedances.

Other features which are considered as characteristic for the invention are set forth in the appended claims.

Although the invention is illustrated and described herein as embodied in a control device for an electronic domestic appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The sole FIGURE of the drawing is a schematic block circuit diagram of a control device for an electronic domestic appliance in accordance with a preferred embodiment according to the invention.

DETAILED DESCRIPTION OF THE INVENTION

Referring now to the FIGURE of the drawing in detail, the control device for an electronic domestic appliance, for example a cooker, a ceramic cook top, a washing machine, a dryer, a dishwasher and the like has a control panel 10 of an electrically conducting material such as for example high-quality steel. It also has an electronic control system with a mains-connected circuit 12, referred to as the first circuit, which has mains connections L, N and a grounding connection PE, and a circuit 14 of protection class II, which is galvanically separated from the mains, and which is also referred to as a second circuit 14.

The term "galvanic" as used herein pertains to an electrical connection that allows a flow of current and may also be referred to as a direct, electrically conductive connection, with "galvanism" being defined as relating to a direct current of electricity.

The control panel 10 is not directly grounded but is electrically connected by way of an electrical connection 16 to the second circuit 14 that is galvanically separated from the mains. That circuit 14 that is galvanically separated from the mains is in turn electrically connected by way of an electrical connection 18 to the mains-connected first circuit 12 which has the grounding connection PE.

If an electrically charged person 20 touches the control panel 10 of the domestic appliance then the charge applied to the control panel 10 can be quickly drained to ground by way of the electrical connection 16, the circuit 14 that is galvanically separated from the network, the electrical connection 18 and the mains-connected circuit 12. In addition the FIGURE shows the equivalent circuit diagram of the electrically charged person 20 with resistance $R_{ESD}$ and capacitance $C_{ESD}$, wherein the capacitance $C_{ESD}$ is charged before touching of the control panel 10 with a high voltage.

For safety reasons the electrical connection 18 between the mains-connected circuit 12 and the circuit 14 that is galvanically separated from the mains is provided with at least one protection impedance which has an adequate dielectric strength and which limits the effective current which can flow away to ground from the mains L, N by way of the person 20, to a level which is safe for the person 20.

In the preferred embodiment shown in the FIGURE, the at least one protection impedance of the electrical connection 18 between the mains-connected circuit 12 and the circuit 14 that is galvanically separated from the mains has a parallel circuit comprising a series connection of two capacitive protection impedances $C_1$ and $C_2$ and a series connection of two ohmic protection impedances $R_1$ and $R_2$. The capacitive protection impedances $C_1$, $C_2$ serve for discharge of the high current gradients (HF-discharge) and the ohmic protection impedances $R_1$, $R_2$ serve for discharge of the static charge (DC-discharge). The at least one protection impedance, or protective impedance, is not limited to the one component and that specific circuit configuration.

With such a control device the charge applied to the control panel 10 can be quickly carried away to ground without violating the regulations for the circuit 14 in protection class II so that a malfunction of the electronic system, caused by electrostatic discharge (ESD), can be reliably prevented.

The invention claimed is:

1. A control device for an electronic domestic appliance, comprising:

a control panel made of electrically conducting material;

an electronic control system having a first circuit connected to mains and a second circuit galvanically separated from the mains;

an electrical connection connecting said control panel and said second circuit, for grounding said control panel; and an electrical connection between said second circuit and said mains-connected first circuit, said electrical connection between said second circuit and said first circuit including at least one protection impedance.

2. The control device according to claim 1, wherein said at least one protection impedance includes at least two series-connected protection impedances.

3. The control device according to claim 1, wherein said at least one protection impedance includes capacitive protection impedances.

4. The control device according to claim 1, wherein said at least one protection impedance includes ohmic protection impedances.

5. A control device for an electronic domestic appliance, comprising:

a control panel of electrically conducting material;

an electronic control system having a first circuit connected to mains and a second circuit galvanically separated from the mains;

an electrical connection connecting said control panel and said second circuit, for grounding said control panel; and an electrical connection between said second circuit and said mains-connected first circuit, said electrical connection between said second circuit and said first circuit including at least one protection impedance; and said at least one protection impedance includes capacitive protection impedances and ohmic protection impedances connected in parallel to said capacitive protection impedances.

* * * * *